US006732692B1

(12) United States Patent
Cetnar et al.

(10) Patent No.: US 6,732,692 B1
(45) Date of Patent: May 11, 2004

(54) DEVICE AND METHOD FOR PROVIDING TAPPET ALIGNMENT

(75) Inventors: Thomas E Cetnar, Roseville, MI (US); Robert A Perkins, Troy, MI (US); Bruce L Raymond, Rochester, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/325,133

(22) Filed: Dec. 20, 2002

(51) Int. Cl.[7] ..... F01L 1/16
(52) U.S. Cl. ..... 123/90.49; 123/90.5
(58) Field of Search ..... 123/90.48, 90.5, 123/41.74, 193.3; 277/598, 591

(56) References Cited

U.S. PATENT DOCUMENTS 2,089,478 A 8/1937 Heiss ..... 123/90
3,998,190 A 12/1976 Keske ..... 123/90.5
4,207,775 A 6/1980 Lintott ..... 74/55
5,022,356 A 6/1991 Morel, Jr. et al. ..... 123/90.5
5,105,777 A * 4/1992 Kronich et al. ..... 123/193.3

FOREIGN PATENT DOCUMENTS

JP 61072809 A * 4/1986 ..... F01L/1/14

* cited by examiner

*Primary Examiner*—Thomas Denion
*Assistant Examiner*—Zelalem Eshete
(74) *Attorney, Agent, or Firm*—Thomas A. Jurecko

(57) ABSTRACT

A device for resisting rotation of a valve tappet, and in particular a roller valve tappet, is provided as part of a cylinder head gasket. The device includes a resilient portion having a flat face contacting a flat surface of a valve tappet to resist rotation thereof. The resiliency of the device urges the flat face against the flat surface of the valve tappet to resist rotation.

7 Claims, 12 Drawing Sheets

DEVICE AND METHOD FOR PROVIDING TAPPET ALIGNMENT

FIELD OF THE INVENTION

The present invention relates generally to internal combustion engines for motor vehicles, and more particularly to a device and method for providing valve tappet or lifter alignment to resist tappet or lifter rotation.

BACKGROUND OF THE INVENTION

Internal combustion engines typically burn an air/fuel mixture to provide the necessary power to operate most motor vehicles. The air/fuel mixture is burned within combustion chambers of cylinders, with the combustion of the mixture providing reciprocation of pistons within the cylinders. A valve train or system controls the amount of air/fuel mixture introduced into the piston cylinders, as well as the exhaust of the burned mixture thereafter.

The valve train or system may include valve tappets or lifters that engage lobes on a camshaft of the engine and are adapted for reciprocation within tappet bores to thereby control the movement of valves that open and close valve ports. The opening and closing of the valve ports resulting from the reciprocating movement of the valve tappets allows an air/fuel mixture into the combustion chamber and the exhaust out of that same chamber. Various types of valve tappets are known for controlling valve operation and include, for example: (1) mechanical flat (or solid) valve tappets; (2) mechanical roller valve tappets; and (3) hydraulic roller valve tappets.

Roller type valve tappets have several advantages over flat type valve tappets, including reduced friction when contacting the lobes on the camshaft, which reduces wear, and increased engine horsepower (e.g., different cam lobe designs provide for increased opening of valve ports). Also, with reduced friction, greater compression may be obtained without increased wear. Thus, roller type valve tappets have been popular in higher performance vehicles (e.g., sports cars) because of the resulting increased engine performance. However, more and more engines in all types of vehicles are now including roller tappets because of their increased life.

These roller type valve tappets are generally heavier than flat type valve tappets, due to the increased component parts and are typically more expensive than the flat type valve tappets. Additionally, roller tappets present the problem that a device must be provided to resist rotation of the valve tappet in order to avoid misalignment of the valve tappet wheel with the lobes of the camshaft.

Various devices and methods are known for providing proper alignment of a roller type valve tappet to thereby resist its rotation. For example, guide members may be provided to resist rotation of the valve tappet. This guide may be implemented in combination with a valve tappet having a non-cylindrical portion that is engaged by a plate or similar member of the guide. Alternately, the valve tappets may be provided with inclined flat portions that are engaged by wedge-shaped guide members. A guide bar may also be provided to resist rotation. It is also known to provide a device that engages the rollers of the valve tappets to thereby resist their rotation.

These known devices require extra parts that result in increased cost (e.g., additional assembly cost due to extra machining and assembly required) and increased weight. Also, these known devices do not provide adaptability for different engine types and sizes (e.g., different size bores, etc.).

SUMMARY OF THE INVENTION

The present invention provides a valve tappet alignment device and method of providing the same that maintains the proper alignment of each valve tappet (i.e., resists rotation of the valve tappet within a tappet bore), is adaptable to different engine types and sizes, and reduces cost and complexity in design. The valve tappet alignment device of the present invention may be incorporated into the engine block design, provided in combination with a valve tappet, or preferably, implemented as part of a cylinder head gasket. Most preferably, the present invention is integrated with a single or multi-layer steel cylinder head gasket blank that would otherwise be considered useless.

Specifically, the present invention provides an alignment device for engaging and providing a lateral force against the valve tappet (i.e., pressing against the side of a valve tappet) to at least resist rotation of the valve tappet during operation, and preferably prevent rotation. The alignment device includes a flat portion to engage the valve tappet and a resilient portion for urging the flat portion against and contacting the valve tappet to maintain its position and resist axial rotation. Tabs extending from the sides of the flat portion may also be provided to further engage the valve tappet and resist rotation.

An alignment device constructed according to the principles of the present invention may be provided separately in connection with each valve tappet, or may be provided as a single unit for use with multiple valve tappets. With individual alignment devices, each device is configurable for the tolerances of each valve tappet bore.

The alignment device of the present invention also may be inverted to accommodate any clearance issues with the engine block, valve tappet, holes or walls. Additionally, the alignment device may be used with different types of valve tappet bores (e.g., offset).

Thus, the alignment device of the present invention and method of providing the same resists rotation of the valve tappet (i.e., roller type valve tappet) during the reciprocating operation of the tappet to thereby maintain alignment with the camshaft lobe. Further, the alignment device may be provided as part of a cylinder head gasket with reduced assembly required, thereby resulting not only in reduced cost, but diminished risk of failure due to improper construction or similar problems. The elegantly simple design also reduces the number of parts needed to maintain the alignment of the valve tappet (i.e., eliminates the need for brackets, fasteners and dogbones used to resist tappet rotation), which also lowers cost.

Additional benefits and advantages of the present invention will become apparent to those skilled in the art to which this invention relates from a reading of the subsequent description of the preferred embodiment and the appended claims, taken in conjunction with the accompanying drawings.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
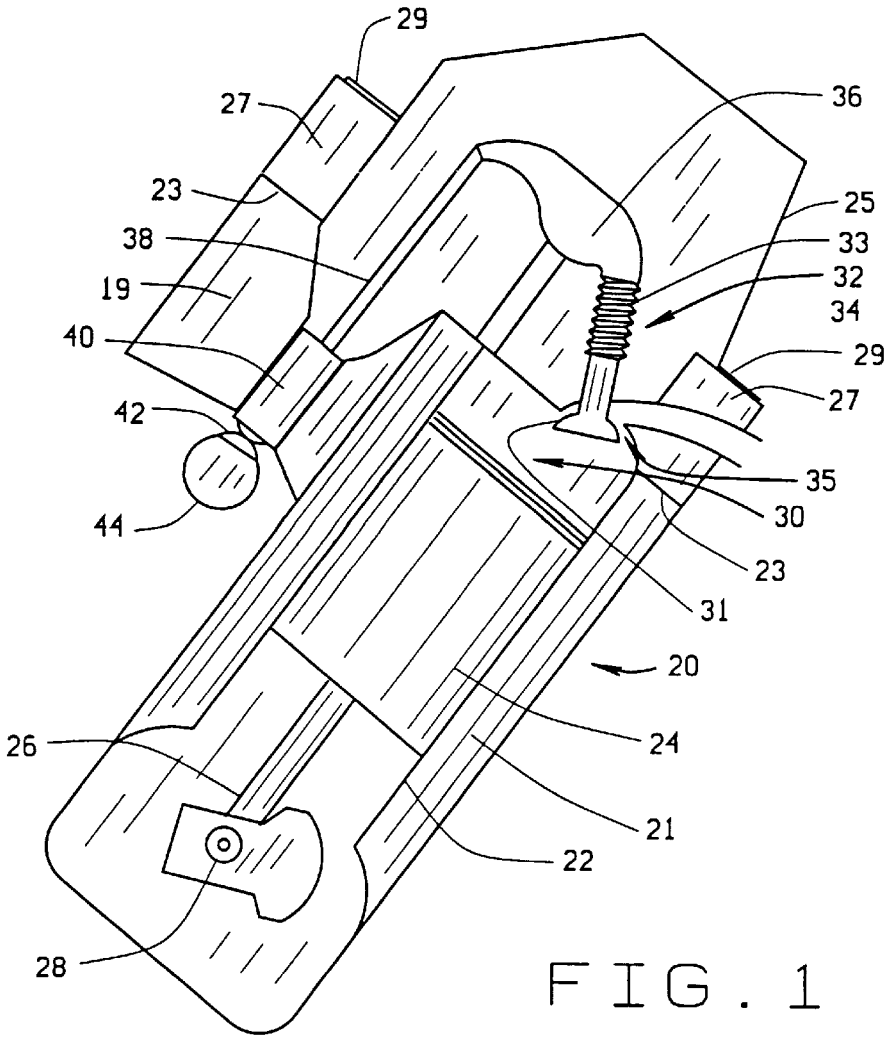
FIG. 1 is a side plan view of a reciprocating piston internal combustion engine in which a valve tappet alignment device constructed according to the principles of the present invention may be implemented.

A reciprocating piston internal combustion engine in which a valve tappet alignment device constructed according to the principles of the present invention may be implemented is shown in FIG. 1 and indicated generally as 20. The engine typically includes a cylinder 22 with a piston 24 adapted for reciprocating movement therein. A single cylinder engine may used in, for example, a lawn mover. Other motor vehicles, including cars, have more than one cylinder, and usually four, six or eight. It should be noted that the cylinders may be mounted within an engine using different configurations, including inline, in a v-shape or flat depending upon the engine requirements and design.

The piston 24 is connected to a crankshaft 28 by a piston connecting rod 26. A combustion chamber 30 provides the compression and combustion for reciprocating the piston 24. An intake valve 32 (e.g., poppet valve) opens at the proper time to let an air/fuel mixture into the combustion chamber 30 for burning to thereby create combustion pressure for reciprocating the piston 24. The reciprocating movement is converted to rotational movement by the crankshaft 28 that is connected by the piston rod 26 to the piston 24. An exhaust valve (not shown) is also provided that opens at the proper time to release exhaust from the combustion chamber 30. As should be appreciated by one of ordinary skill in the art, more than one set of intake and exhaust valves may be provided per cylinder 22.

The timing of the opening arid closing of the valves is provided by a valve train or system. With respect specifically to the valve train or system, the intake valve 32 (and exhaust valve) include a valve stem 34 having a circular head 31 at one end for sealing an intake port 35 (or exhaust port not shown), and is connected at the other end to a rocker arm 36. The valve stem 34 typically includes a valve spring 33 for moving the valve stem 34 to close the valve port 35 when necessary, and to maintain a tight sealing engagement of the circular head 31 against the valve port 35 when in the closed position. A pushrod 38 is connected to the rocker arm 36 at an end opposite to the valve stem 34. The pushrod 38 includes a valve tappet 40 connected thereto, with the valve tappet engaging a cam or lobe 42 of a camshaft 44. The valve tappet 40 shown in FIG. 1 is a roller valve tappet as described herein.

The lobe 42 is positioned on the camshaft 44 such that rotation of the camshaft 44 causes rotation of the lobe 42, resulting in reciprocation of the valve tappet 40. Thus, the rotational motion of the camshaft 44 is converted to linear motion for opening and closing the intake valve 32 (or exhaust valve). The configuration (e.g., shape and alignment on the camshaft 44) of the lobe 42 provides the proper timing of valve opening and closing. It should be noted that other camshaft configurations are possible, including an overhead camshaft which requires modification of the component parts as is known.

A valve cover 25 is typically connected to a cylinder head 27 to provide a sealed environment for the cylinder 22 and related valve parts in the valve train. The cylinder head encloses and covers the cylinders 22. A valve gasket 29 is provided between the valve cover 25 and cylinder head 27 to mate these parts and to prevent any fluid leakage (i.e., oil leaking from the cylinder head 27). Between the cylinder block 21 and the cylinder head 27 is a cylinder head gasket 23 to provide a tight seal and prevent fluid leakage. It should be noted that the cylinder block 21 as shown is part of an engine block 19.

Figure 3:
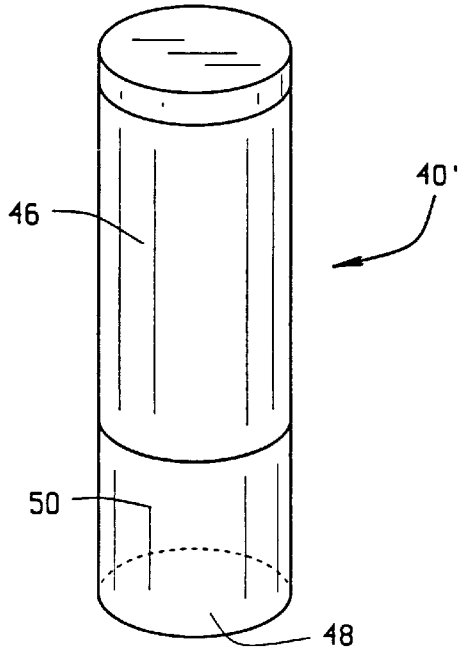
FIG. 3 is a perspective view of a flat type valve tappet.
Figure 4:
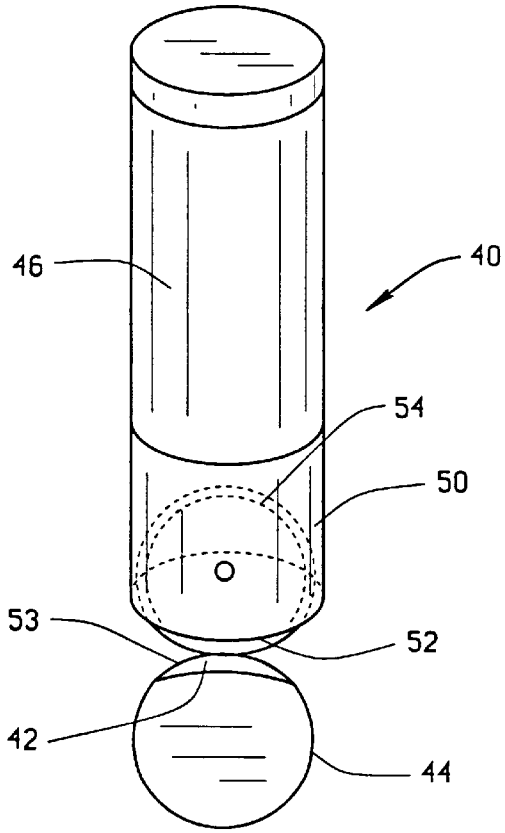
FIG. 4 is a perspective view of a roller type valve tappet.

Different types of valve tappets may be provided including a flat valve tappet 40' as shown in FIG. 3 or a roller valve tappet 40 as shown in FIG. 4. Both valve tappets 40 and 40' have a generally cylindrical body 46. However, the flat valve tappet 40' is provided with a flat surface 48 on a lower end 50 for engaging the lobe 42. The roller valve tappet 40 is provided with a roller wheel 52 on a lower end 50 for engaging the lobe 42. The roller wheel 52 is provided with a flat periphery 54 for engaging a corresponding flat surface 53 on the lobe 42.

Figure 2:
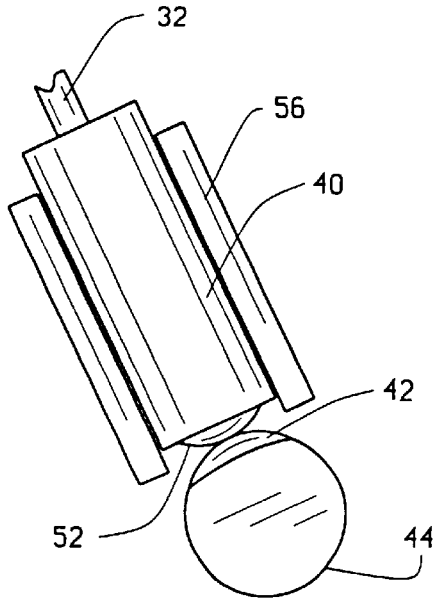
FIG. 2 is a side plan view of a valve bore having a valve tappet therein for use in a reciprocating piston internal combustion engine in which a valve tappet alignment device constructed according to the principles of the present invention may be implemented.

As shown in FIG. 2, a roller valve tappet 40 is adapted for reciprocation within a tappet bore 56, which reciprocating movement is provided by the rotation of the camshaft 44. During operation (i.e., reciprocation), the roller valve tappet 40 experiences vibratory and other forces from the engine and other parts within the engine. Thus, the roller valve tappet 40 has a tendency to rotate axially within the tappet bore 56 during operation. When using a flat valve tappet 40', the flat surface 48 always engages the lobe 42. However, when using a roller valve tappet 40, rotation of the tappet 40 within the tappet bore 56 results in misalignment of the roller wheel 52 and the lobe 42.

Figure 5:
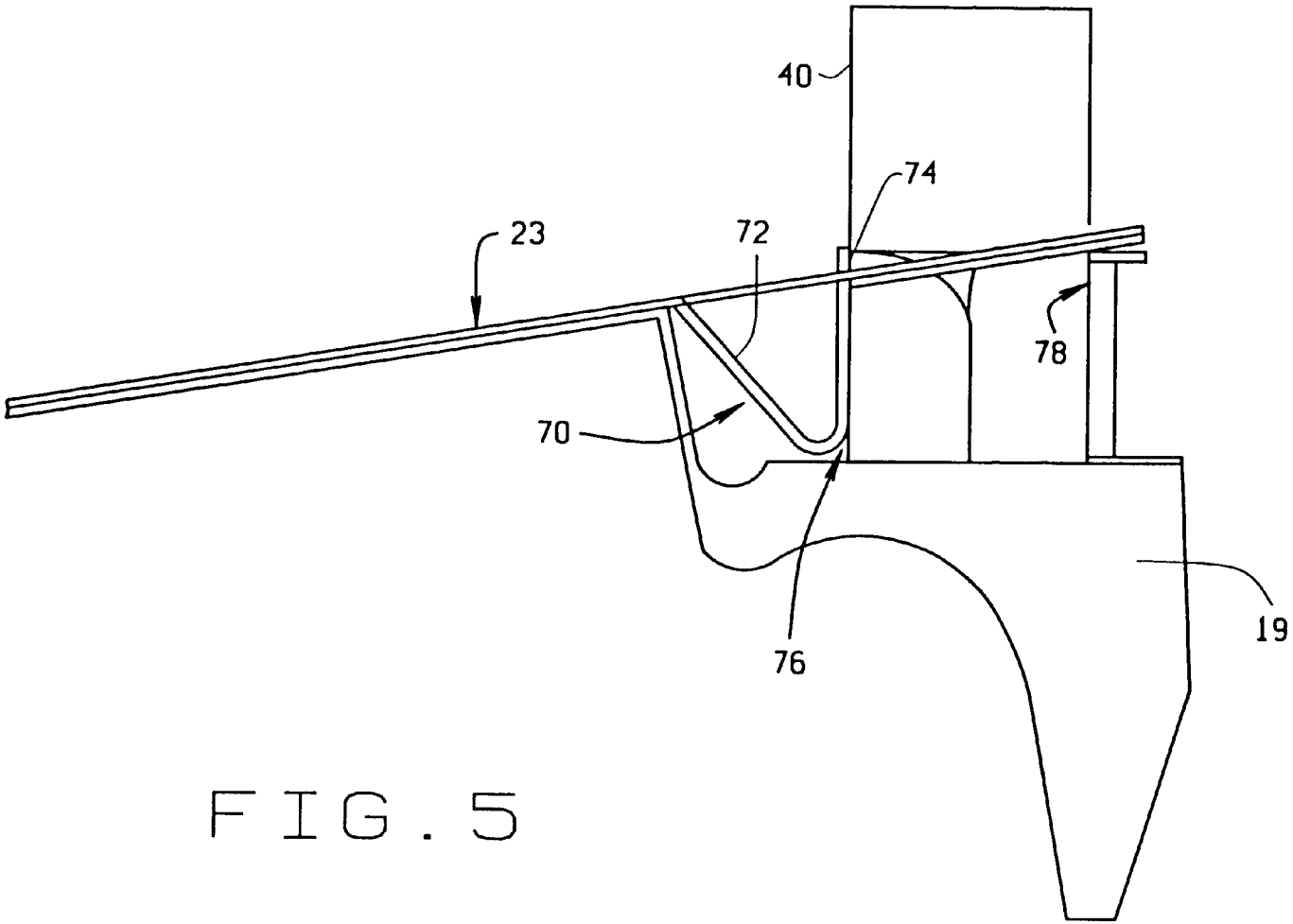
FIG. 5 is a side plan view of a tappet alignment device constructed according to the principles of the present invention implemented within a valve train of a reciprocating piston internal combustion engine.
Figure 6:
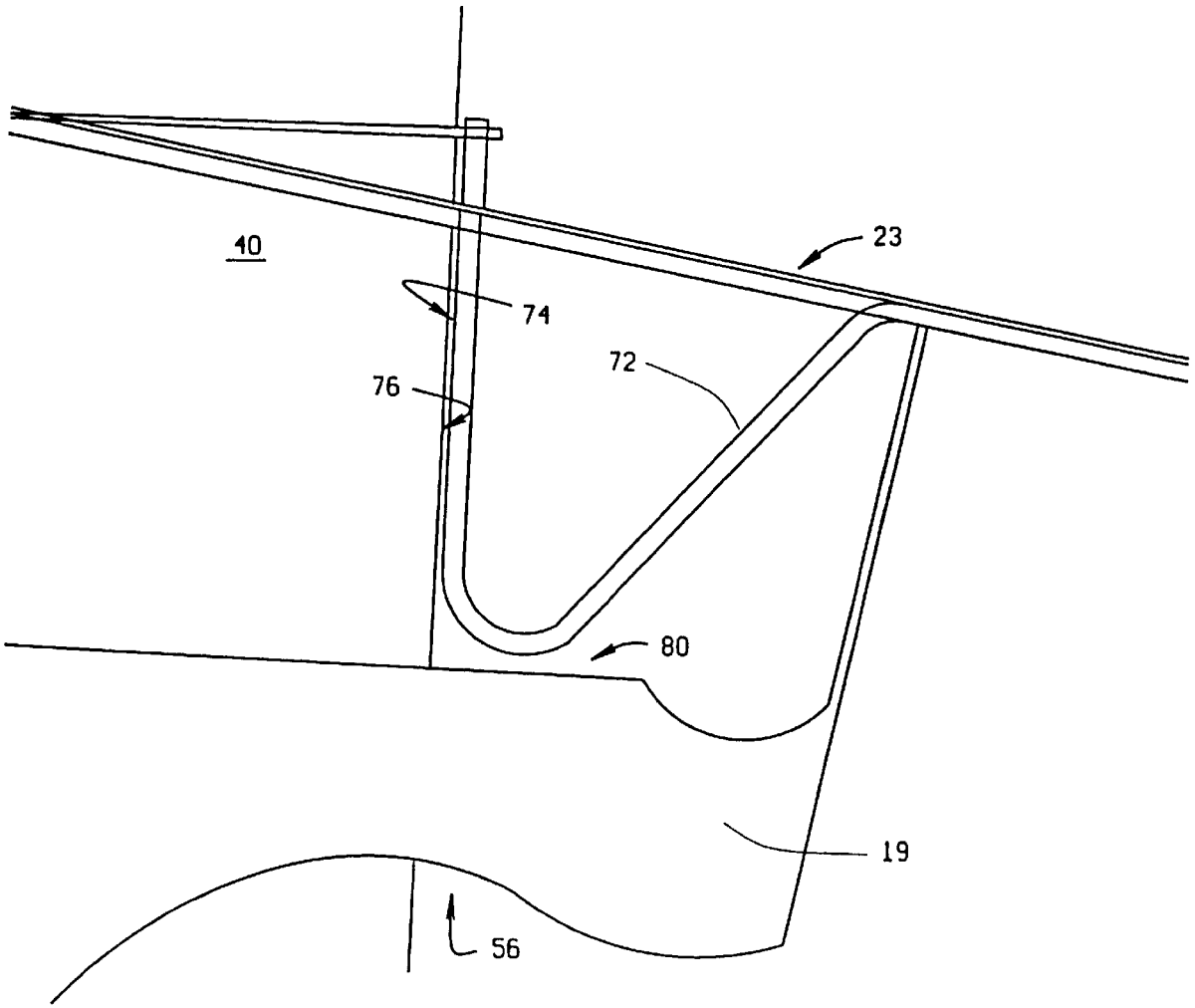
FIG. 6 is an exploded side plan view of a tappet alignment device constructed according to the principles of the present invention implemented within a valve train of a reciprocating piston internal combustion system.

Having described different types of valve tappets as shown in FIGS. 3 and 4, for use in a reciprocating engine 20 as shown in FIG. 1, a valve tappet alignment device constructed according to the principles of the present invention that may be implemented in the reciprocating engine 20 for resisting rotation of the valve tappets, is shown in FIGS. 5 and 6 and indicated generally as 70. Specifically, the valve tappet alignment device 70 includes a folded or hinged section 72 that is preferably resilient (i.e. a resilient portion). A flat horizontally extending portion or face 74 is preferably provided as part of the alignment device 70 and extends generally parallel to a side of the valve tappet 40. The valve tappet 40 preferably includes a longitudinal flat surface 76 for engagement by the flat face 74. Another longitudinal flat surface 78 also may be provided on a diametrically opposite side of the valve tappet 40 for engagement by another alignment device 70 (not shown). The flat surfaces 76 and 78 are preferably axially aligned within the tappet bore 56 such they are 180 degrees apart and on opposite sides relative to the tappet wheel 52.

Figure 14:
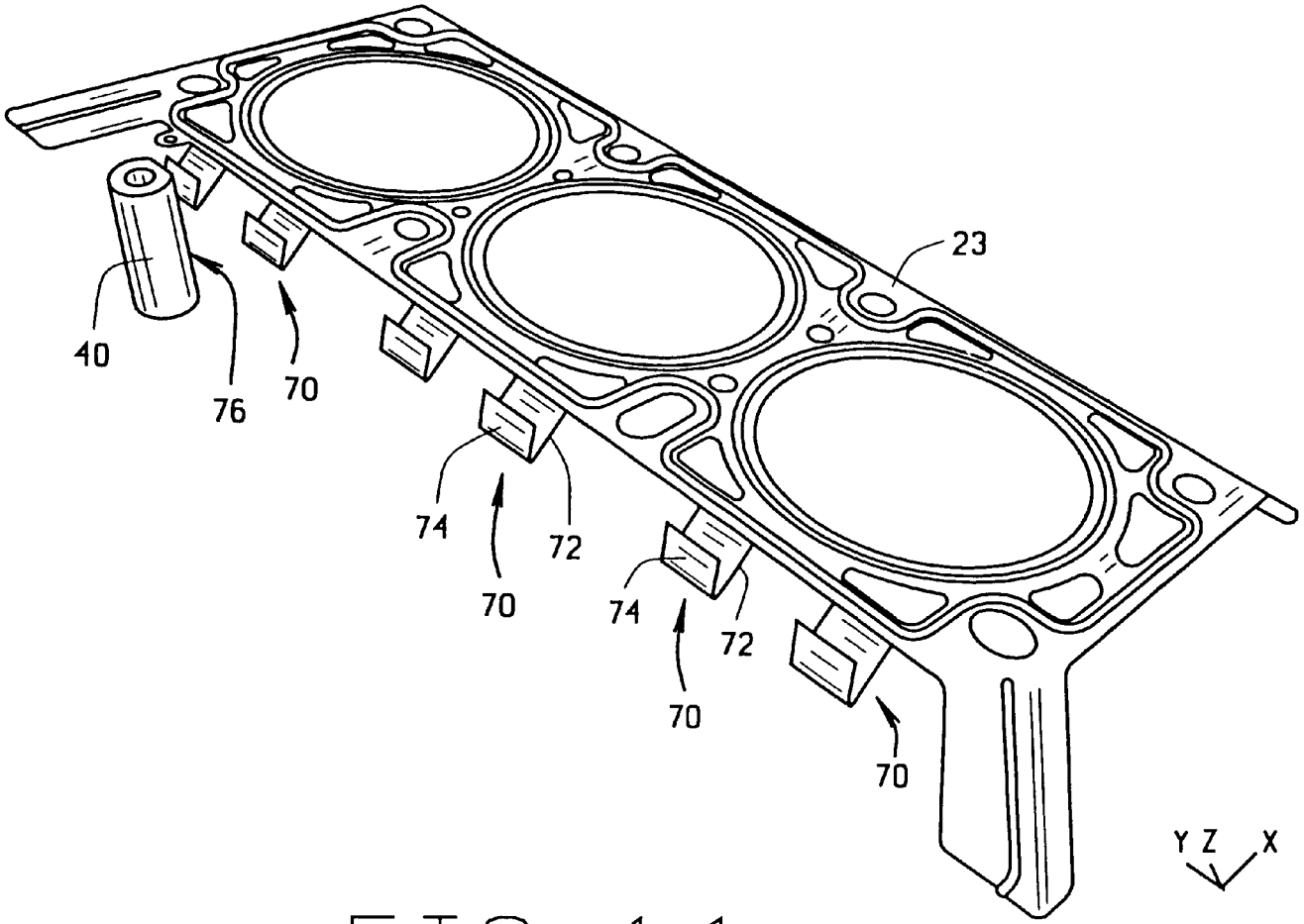
FIG. 14 is a top perspective view of a cylinder head gasket including a tappet alignment device constructed according to the principles of the present invention.

Referring again to FIGS. 5 and 6, and additionally to FIG. 14, the alignment device 70 is preferably provided as part of the cylinder head gasket 23. The alignment device 70 is preferably integrated with the cylinder head gasket 23 during manufacture. However, the alignment device 70 may be connected to the cylinder head gasket 23 after the manufacture thereof. As shown in FIGS. 5 and 6, a gap 80 is preferably provided between the bottom of the folded or hinged section 72 and the engine block 19 having the tappet bore 56 therein. However, the folded of hinged section 72 may be provided in contact with the engine block 19 to provide further support for resisting rotation of the valve tappet 40.

Figure 7:
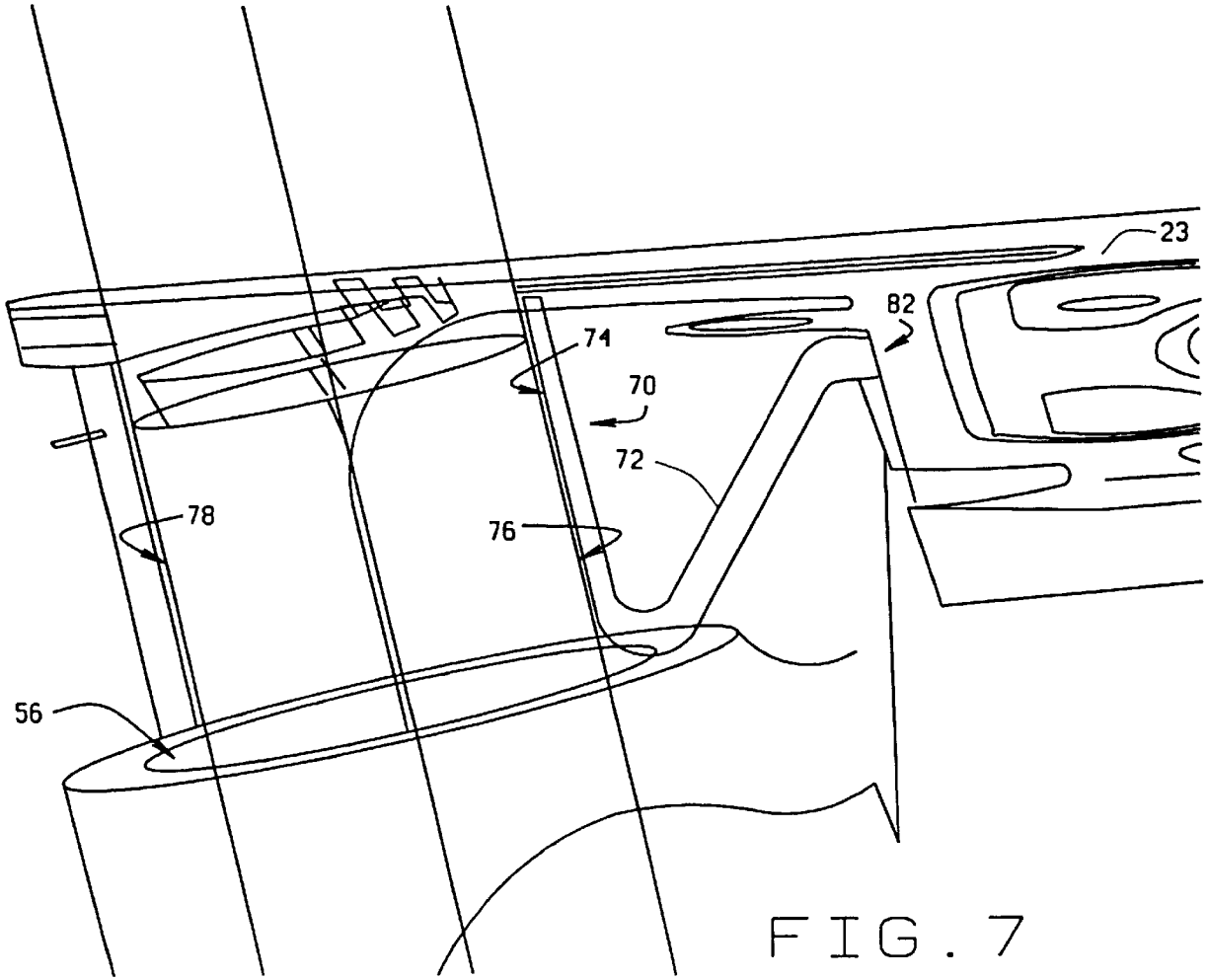
FIG. 7 is a top perspective view of a tappet alignment device constructed according to the principles of the present invention implemented within a valve train of a reciprocating piston internal combustion engine.
Figure 8:
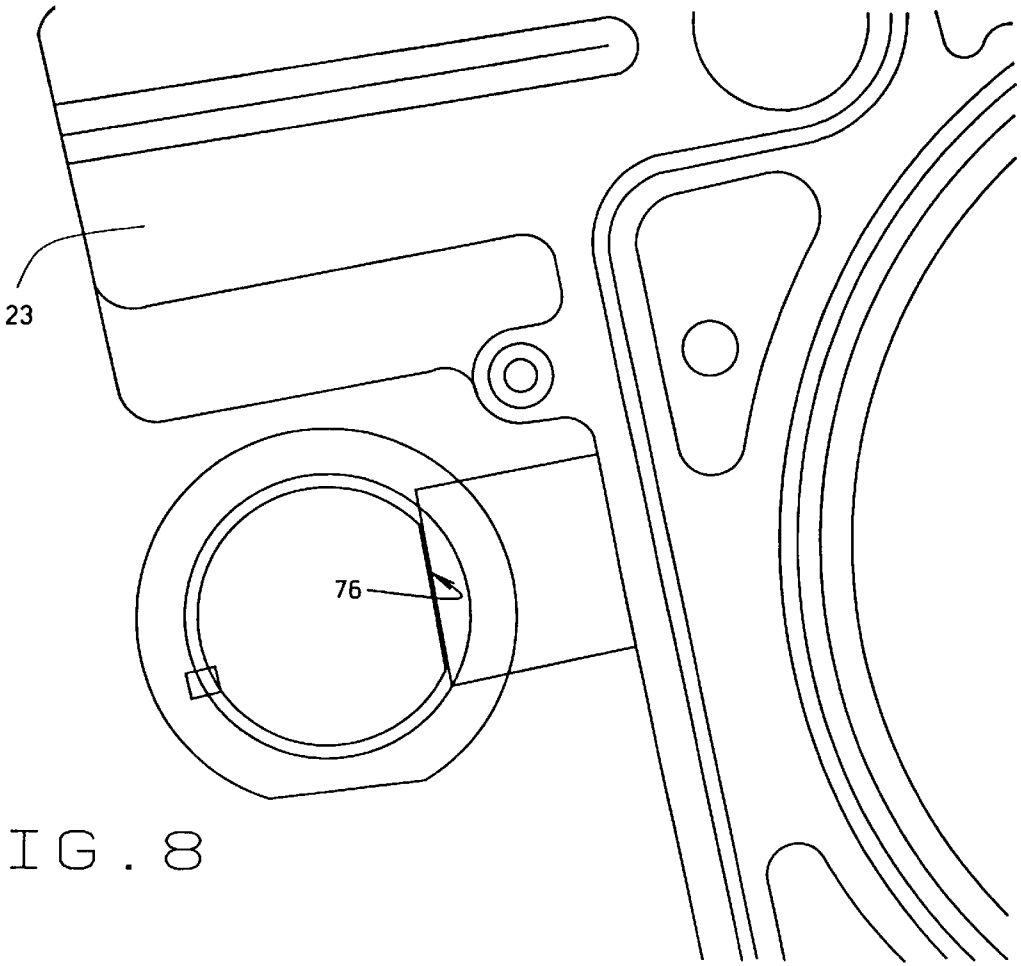
FIG. 8 is a cross-sectional top plan view of a tappet alignment device constructed according to the principles of the present invention implemented within a valve train of a reciprocating piston internal combustion engine.

As shown in FIG. 7, the hinged or folded section 72 of the alignment device 70 is preferably sloped or curved from an end 82 that is connected to the cylinder head gasket 23, to the flat face 74, which is configured in a generally horizontal direction parallel to the valve tappet 40. As shown more clearly in FIG. 8, the valve tappet 40 is provided with at least the generally longitudinal flat surface 76 for contacting and engagement by the flat face 74 of the alignment device 70.

However, it should be noted that the alignment device 70, including the hinged or folded section 72, is not limited to a particular shape or configuration. Other designs may be provided such that an alignment device 70 includes a resilient portion for engaging the valve tappet 40 and resisting rotation. For example, a spring loaded or similar member could be provided to engage and resist rotation of the valve tappet 40. Also, additional elements may be provided as part of the alignment device 70 to resist rotation. For example, tabs 90 extending from the sides of the horizontally extending face 74 may be provided to further contact the tappet 40.

Figure 9:
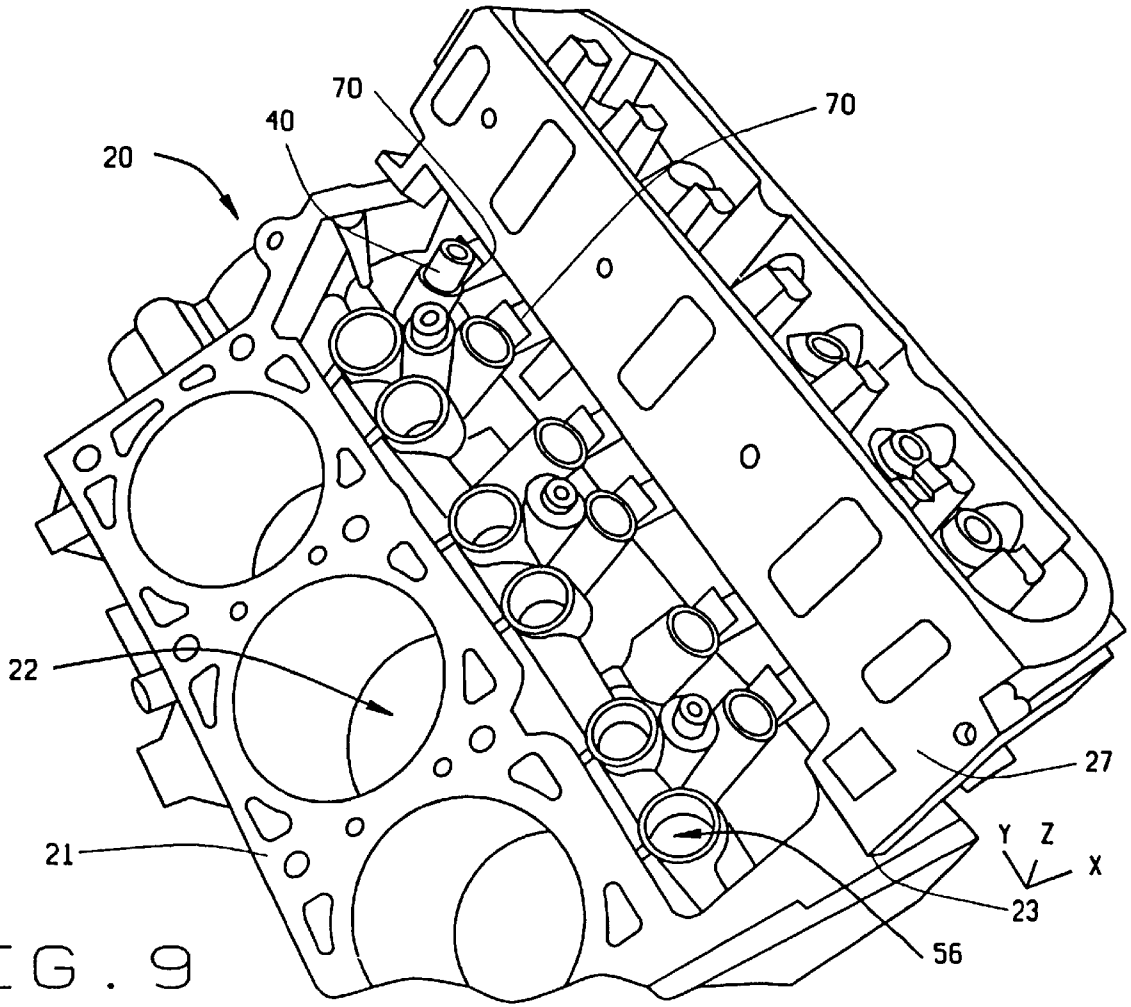
FIG. 9 is a top perspective view of a reciprocating piston internal combustion engine block having a tappet alignment device constructed according to the principles of the present invention implemented therein.
Figure 10:
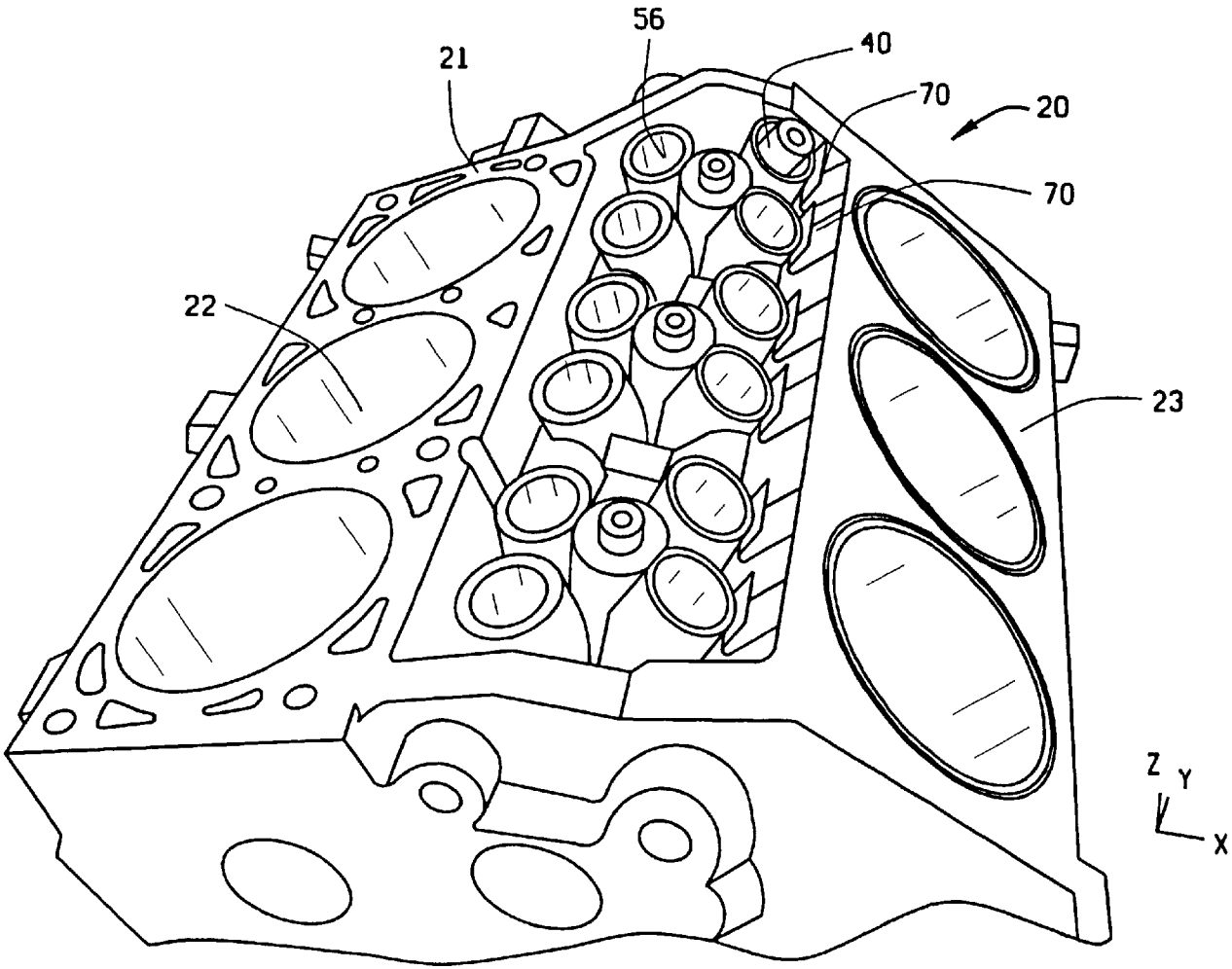
FIG. 10 is a top perspective view of a reciprocating piston internal combustion engine block having a tappet alignment device constructed according to the principles of the present invention implemented therein as part of a cylinder head gasket.
Figure 13:
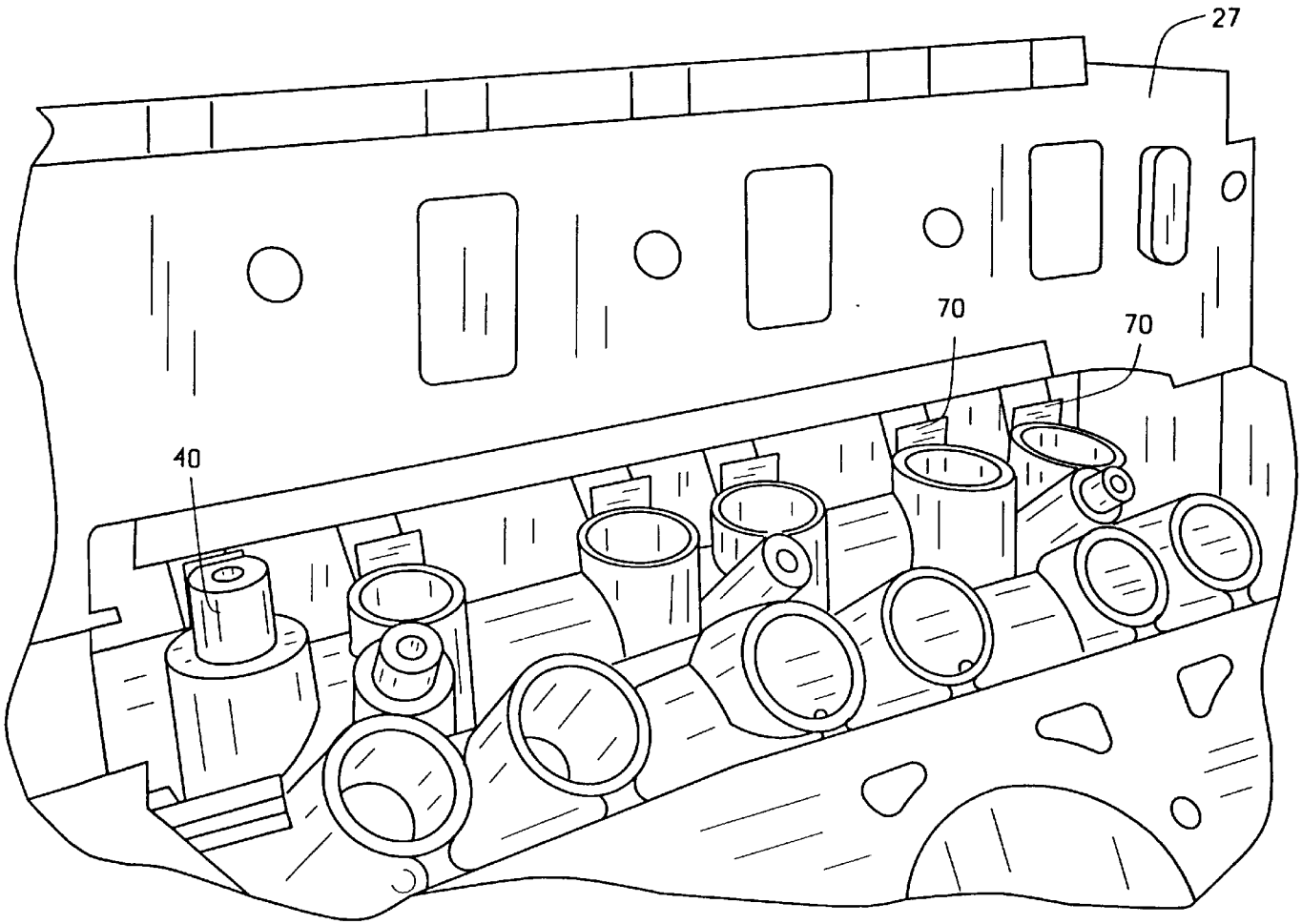
FIG. 13 is a side perspective view of tappet bores of a reciprocating piston internal combustion engine block with a tappet alignment device constructed according to the principles of the present invention implemented therein.

Thus, a valve tappet alignment device 70 constructed according to the principles of the present invention is easily implemented within a reciprocating piston internal combustion engine 20, and most preferably as part of a cylinder head gasket 23. Specifically, and referring to FIGS. 9, 10 and 13, as shown therein, a six-cylinder v-shaped internal combustion engine 20 includes tappet alignment devices 70 provided as part of a cylinder head gasket 23. As shown in FIG. 10, a cylinder head gasket 23 is provided with a separate valve tappet alignment device 70 for engaging each tappet 40. Thus, for each cylinder 22, two tappet alignment devices 70 are provided (i.e., one for the intake valve tappet and one for the exhaust valve tappet). The cylinder head 27 is typically bolted onto the cylinder block 21 with the cylinder head gasket 23 therebetween as shown in FIG. 9. The tappet alignment devices 70 extend beyond the cylinder head 27 to engage the reciprocating tappets 40 within the tappet bores 56.

Figure 11:
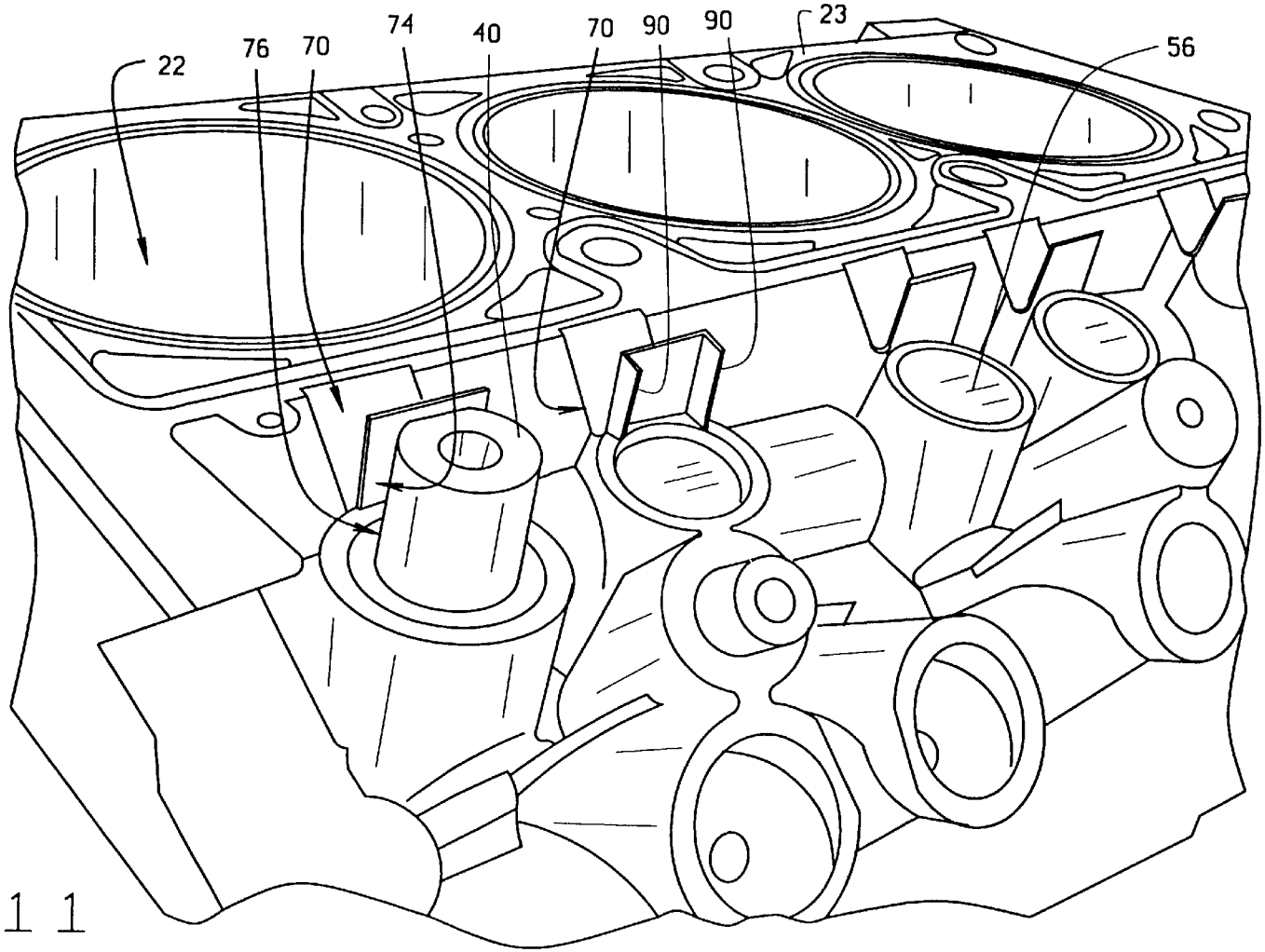
FIG. 11 is an exploded top perspective view of a reciprocating piston internal combustion engine block having a tappet alignment device constructed according to the principles of the present invention implemented therein.
Figure 12:
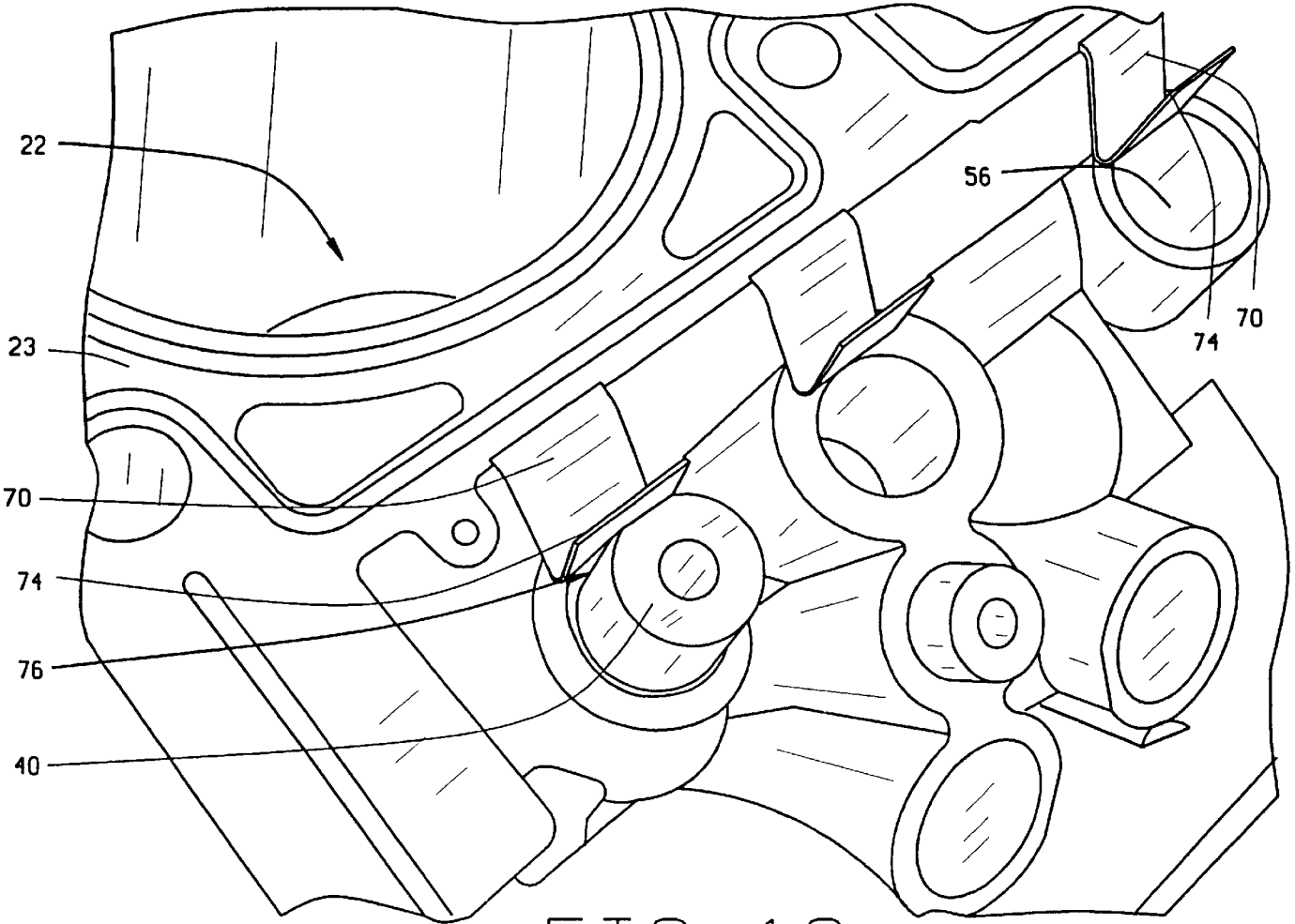
FIG. 12 is a top perspective view of tappet bores of a reciprocating piston internal combustion engine block with a tappet alignment device constructed according to the principles of the present invention implemented therein.

In operation, and as shown more clearly in FIGS. 11 and 12, the flat face 74 of the alignment device 70 is urged or pressed against the flat surface 76 or 78 to maintain the axial alignment of the valve tappet 40 within the tappet bore 56 and resist its rotation, which may be caused by engine vibration. Also, as shown in FIG. 14, the alignment device 70 is preferably provided as part of a cylinder head gasket 23, thereby resulting in adaptability and ease in replacement.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A cylinder head gasket for use in an internal combustion engine, the gasket comprising:

a projection arranged to engage a tappet in the engine in which the gasket is installed to prevent rotation of the tappet, wherein the projection comprises a spring biased end section arranged to engage a flat surface on the tappet.

2. The cylinder head gasket of claim 1, wherein the end section further comprises engagement tabs extending therefrom to further contact the tappet.

3. The cylinder head gasket of claim 1, wherein the projection comprises a first section extending from the gasket and a spring biased second section hingedly connected to the first section and arranged to engage a flat surface on the tappet.

4. An internal combustion engine having a cylinder block with cylinders positioned therein, a cylinder head enclosing an end of the cylinders, a plurality of valves for venting the cylinders, an actuation mechanism including valve tappets having flattened side portions formed therein for operating the valves, the internal combustion engine comprising:

a cylinder head gasket positioned between the cylinder block and the cylinder head and including a plurality of resilient members positioned to engage a respective one of the flattened portions of the valve tappets to prevent rotation of the tappets, wherein the resilient members are integrally formed with the gasket and extend therefrom.

5. The internal combustion engine of claim 4, wherein the resilient members comprise a first section extending form the gasket and a second section hingedly connected to the first section and arranged to engage the respective flat portions on the tappets.

6. The internal combustion engine of claim 4, wherein the resilient members comprise a spring biased end portion, the spring biased end portion arranged to urge the resilient members against the respective flat portions of the tappets.

7. The internal combustion engine of claim 4, wherein the resilient members further comprise engagement tabs extending therefrom to further contact the tappets.

* * * * *

UNITED STATES PATENT AND TRADEMARK OFFICE

CERTIFICATE OF CORRECTION

PATENT NO. : 6,732,692 B1
DATED : May 11, 2004
INVENTOR(S) : Cetnar et al.

It is certified that error appears in the above-identified patent and that said Letters Patent is hereby corrected as shown below:

Title page,
Item [54], Title,
"[54] DEVICE AND METHOD FOR PROVIDING TAPPET ALIGNMENT"
should be -- [54] DEVICE FOR PROVIDING TAPPET ALIGNMENT --

Signed and Sealed this

Twenty-sixth Day of October, 2004

JON W. DUDAS
*Director of the United States Patent and Trademark Office*